US005642130A

United States Patent [19]

Browne

[11] Patent Number: 5,642,130

[45] Date of Patent: Jun. 24, 1997

[54] DISPLAY ARRAY AND POWER CONTROL CIRCUIT

[75] Inventor: John Browne, Oakville, Canada

[73] Assignee: Mark IV Industries Limited, Mississauga, Canada

[21] Appl. No.: 373,756

[22] Filed: Jan. 17, 1995

[51] Int. Cl.[6] ..... G09G 3/34

[52] U.S. Cl. ..... 345/111; 345/84; 345/214

[58] Field of Search ..... 345/108–111, 82, 345/83, 211, 212, 213, 214, 39; 340/815.62, 815.64, 815.83, 815.85, 815.86, 815.87, 815.9, 815.91, 815.92, 815.8, 815.4; 315/174

[56] References Cited

U.S. PATENT DOCUMENTS

| | | | |
|---|---|---|---|
| 4,069,480 | 1/1978 | Helwig | 340/815.62 |
| 4,156,872 | 5/1979 | Helwig | 340/815.86 |
| 4,342,947 | 8/1982 | Bloyd | 345/39 |
| 4,727,367 | 2/1988 | Noda | 345/82 |
| 4,779,082 | 10/1988 | Salam | 340/815.62 |
| 4,794,391 | 12/1988 | Costa et al. | 345/108 |
| 4,797,599 | 1/1989 | Ference et al. | 315/194 |
| 5,021,773 | 6/1991 | Browne | 345/111 |
| 5,050,325 | 9/1991 | Browne | 40/447 |
| 5,055,832 | 10/1991 | Browne | 345/110 |
| 5,266,935 | 11/1993 | Wahlert | 345/111 |
| 5,325,108 | 6/1994 | Salam | 345/108 |
| 5,550,558 | 8/1996 | Salam | 340/815.62 |

FOREIGN PATENT DOCUMENTS 316493 5/1989 European Pat. Off. .

*Primary Examiner*—Steven Saras

[57] ABSTRACT

An array of display elements are driven between ON and OFF positions where an element bright side is or is not displayed in the viewing direction by a magnetic field individual to each element. A Hall effect switch is located in each field and used to control a circuit in accord with the field polarity. The circuit may be used to provide lights which augment the appearance of an element in a viewing direction. A power control circuit using a phase control and a clipper is used to power the lights and the Hall element.

12 Claims, 5 Drawing Sheets

Figure 1:
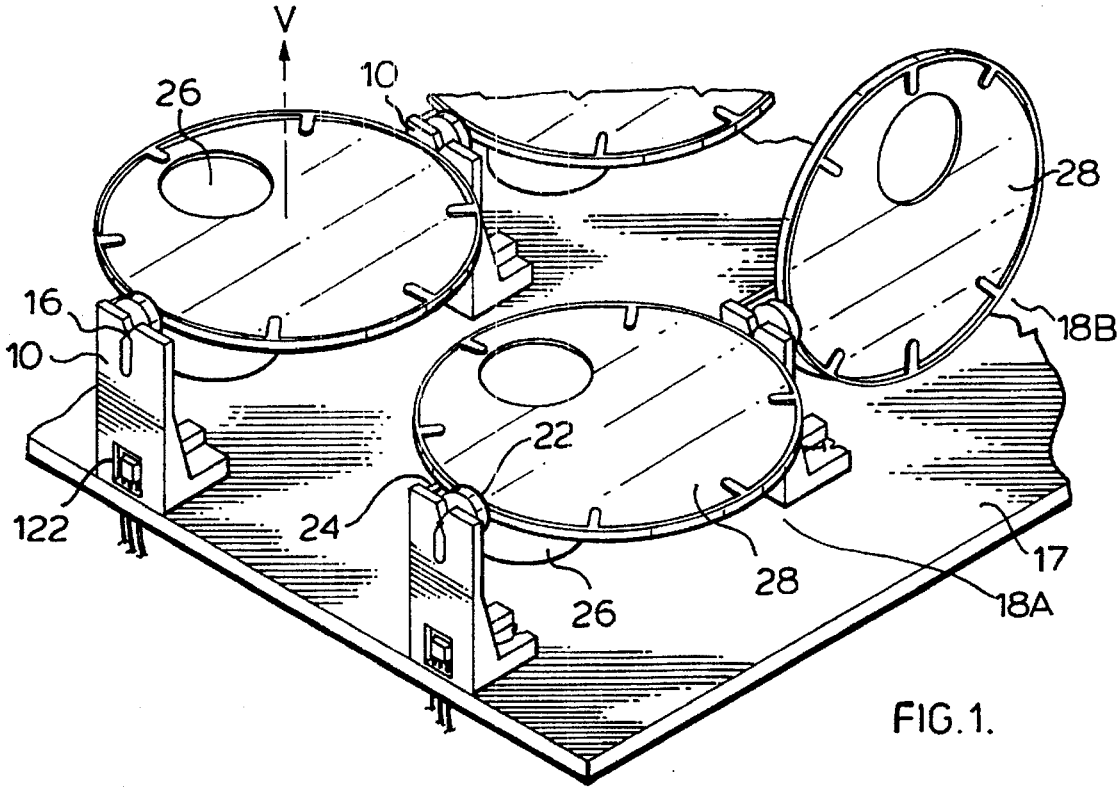

FIG. 3.
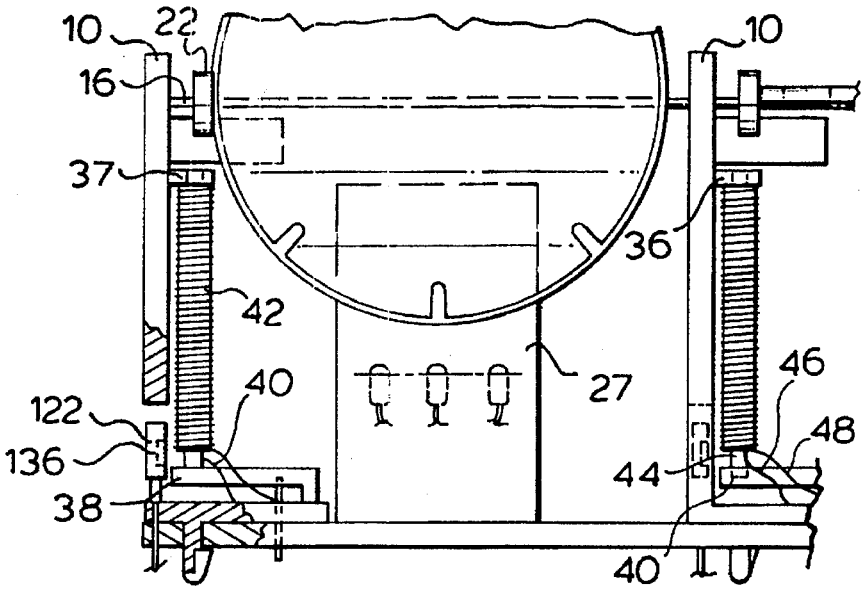
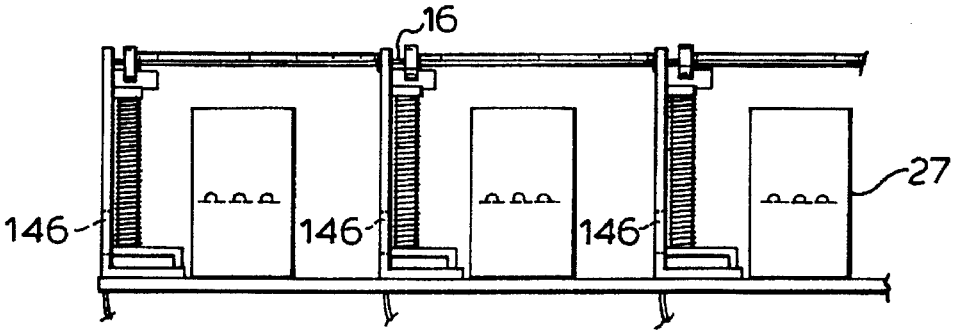
FIG. 4.
FIG. 5.
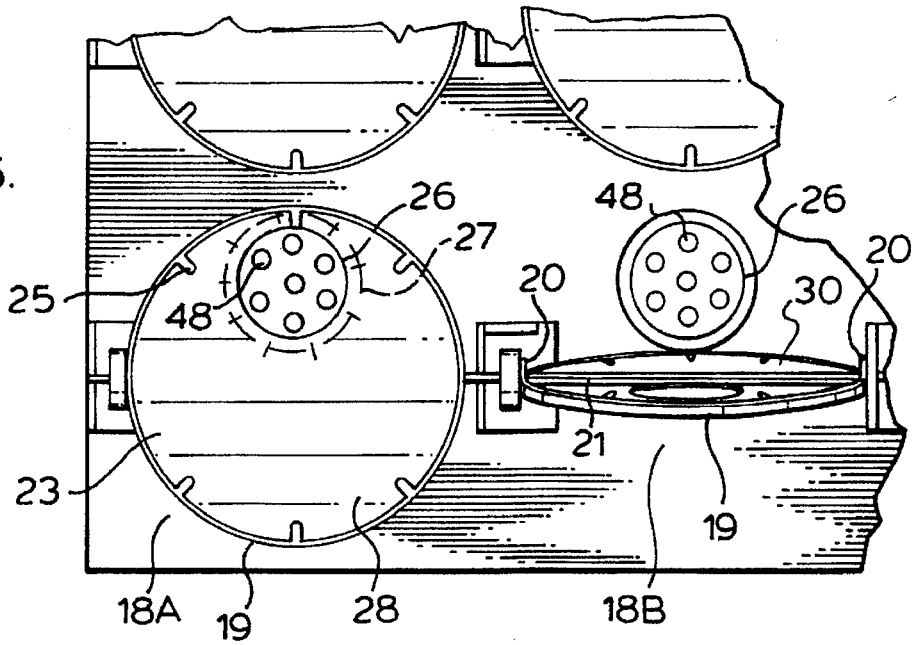

DISPLAY ARRAY AND POWER CONTROL CIRCUIT

This invention relates to a novel electromagnetic display device; to a power control circuit suitable for controlling a light source used in association with a display: and to a display controlled by said circuit.

For some years there has been provided an electromagnetic display element comprising a moving element (usually a rotor) and a stator. The display element is designed to be viewed within a cone of locations surrounding a viewing direction. The rotor is designed to move between a first position wherein a bright surface is displayed to observers in a viewing cone and a second position where the bright surface is obscured in the viewing cone.

A reversible magnetic field provided by the stator 'biases' the rotor to the position determined by the sense of the magnetic field. By 'biases' are included the facts that when the field biases the rotor toward a position, the rotor will either move to said position if it was in the other or if already there, will be held in such position by the field.

Examples of such devices are shown in the following U.S. Patents, owned by applicant :

| | | |
|---|---|---|
| 4,744,163 | May 17, 1988 | Browne |
| 4,566,210 | Jan 28, 1986 | Browne |
| 5,050,325 | Sep 24, 1991 | Browne |
| 5,055,832 | Oct 8, 1991 | Browne |

In accord with one aspect of the invention, a Hall effect switch is located with its sensor in the stator magnetic field, to assume open and closed states to conform to one or the other polarity of the stator magnetic field. The Hall switch may be used to switch a light on or off to augment or not the visibility of the bright side of the moving element. The Hall switch may alternatively be used to operate a slave or monitoring circuit. Where a light is used a light emitting diode ("LED") is preferred because of its high intensity relative to power, but any light is within the scope of the invention. Usually a cluster of LEDs are used.

Examples of devices where the appearance of the bright side of the movable element is augmented by the light from a light source (visible in the viewing cone) are shown in the following U.S. Patent, owned by applicant:

U.S. Pat. No. 5,050,325 ('325) Sep. 24, 1991 Browne.

The '325 patent demonstrates the use of light emitting diodes (LED s) to augment the appearance of the movable element when in its bright state. In the '325 patent, the illumination of the associated LEDs is controlled by a reed switch actuated by the magnetic field associated with the stator of the associated movable member. However the reed switch is sensitive only to the magnetic field rather than its polarity and therefore requires special added magnetic circuit design to render the reed switch responsive to the field polarity.

In accord with this invention there is provided a device where each LED circuit, associated with a magnetic field-driven electric device, is controlled by a Hall effect switch including a Hall effect element located in the magnetic field. The Hall effect switch is connected to cause illumination of the LED when the bright side of the display element is displayed to the viewer and to cause the LED to be OFF when the display element bright side is obscured.

The Hall effect switch can, in accord with the invention, be used for other purposes such as controlling a slave display, sensing the polarity of the field for monitoring purposes and other functions.

Although in one aspect of the invention the Hall effect switch is used with a rotating disk element, the Hall effect switch may be used with any display having elements moved by a magnetic field or core. Examples of such elements are :

| | | |
|---|---|---|
| 4,860,470 | Aug 29, 1989 | Browne |
| 4,744,163 | May 17, 1988 | Browne |
| 4,616,221 | Oct 7, 1986 | Tanaka |
| 4,566,210 | Jan 28, 1986 | Winrow et al |
| 4,426,799 | Jan 24, 1984 | Winrow |

it being noted that a device with multiple cores such as that in U.S. Pat. No. 4,860,470 or U.S. Pat. No. 4,566,210 may have a Hall effect switch corresponding to each core.

It is a further aspect of the invention, when used with a light augmented display, to provide that the power for the LEDs and for a Hall switch is supplied through a dimmer which has a phase control device (such as a Triac or SCR) which control the portion of each supply cycle passed. The dimmer is often required because the LEDs may be too bright and distract or dazzle the motorist or viewer at night. The Hall switch has a voltage limit so that a clipper or voltage clamp passing voltage only below such limit, is provided in series with the phase control. This phase control has been found to be a very efficient power supply, since no power is expended during the portion of each cycle when the supply is cut off.

Thus with an array of light augmented display elements, power for the light augmented elements as a group is supplied from rectified AC, with the requisite portion of each cycle passed by the phase controlled dimmer and clipped at the voltage limit for each Hall effect device. Each LED cluster for an element in the array is then individually energized (or not) by such power supply through a Hall effect switch whose state is therefore controlled by the magnetic core which drives the same element.

Figure 2:
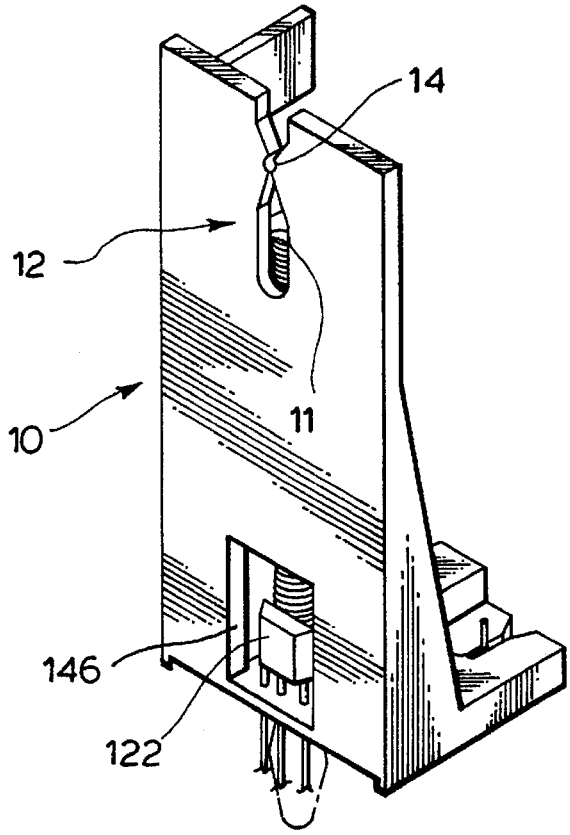
Figure 6:
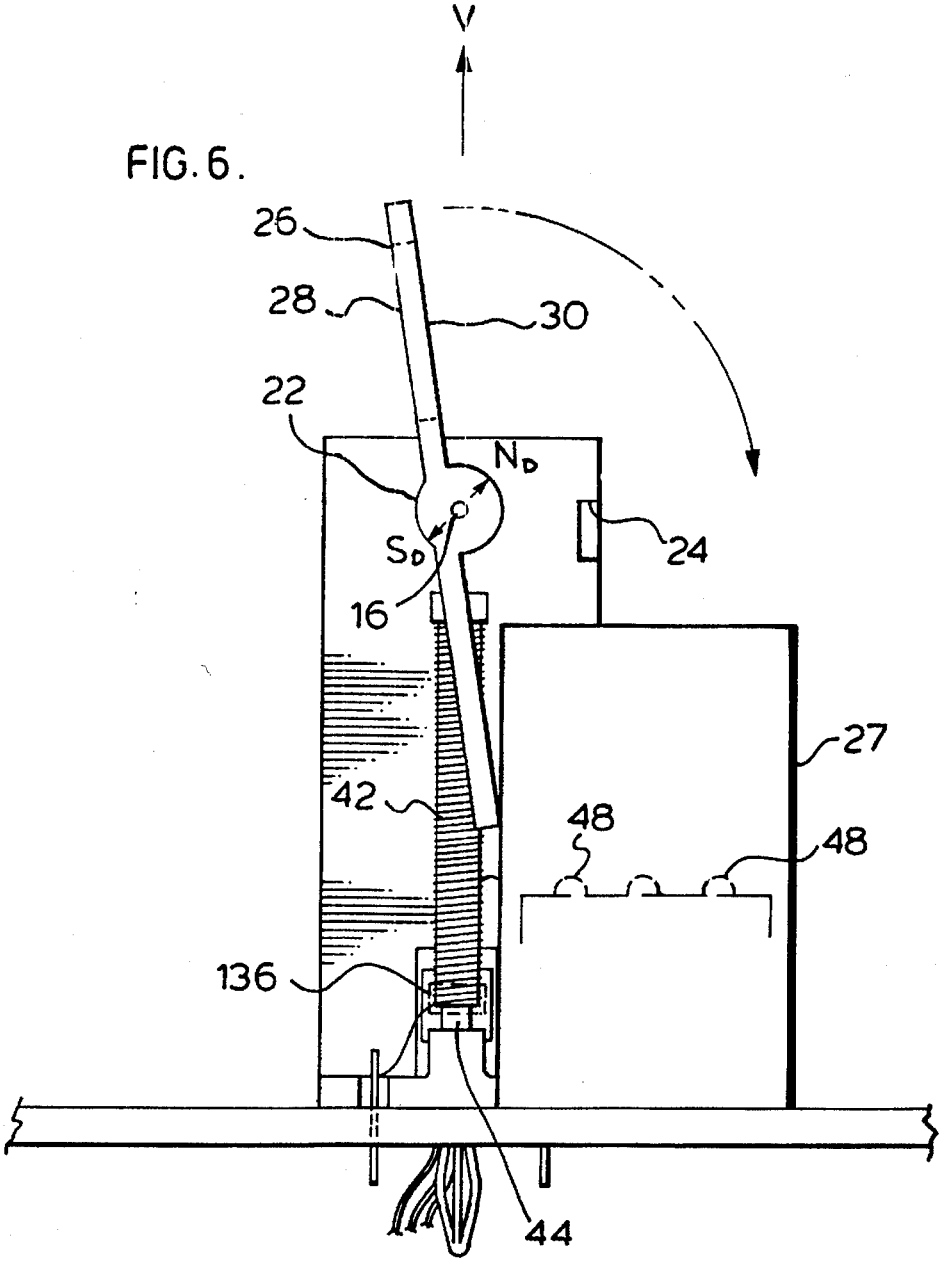
Figure 6A:
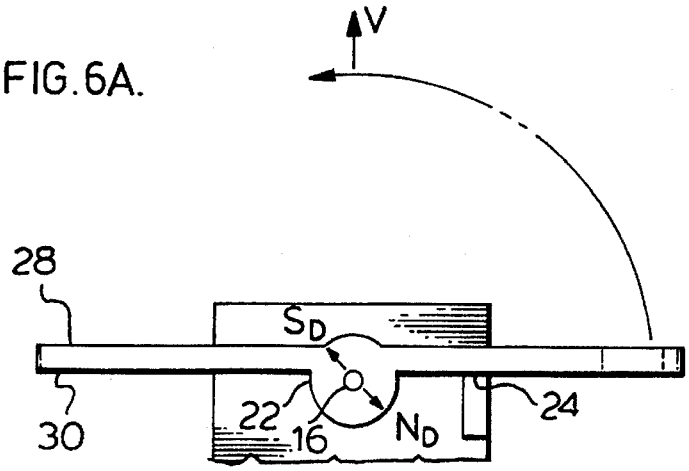
Figure 7:
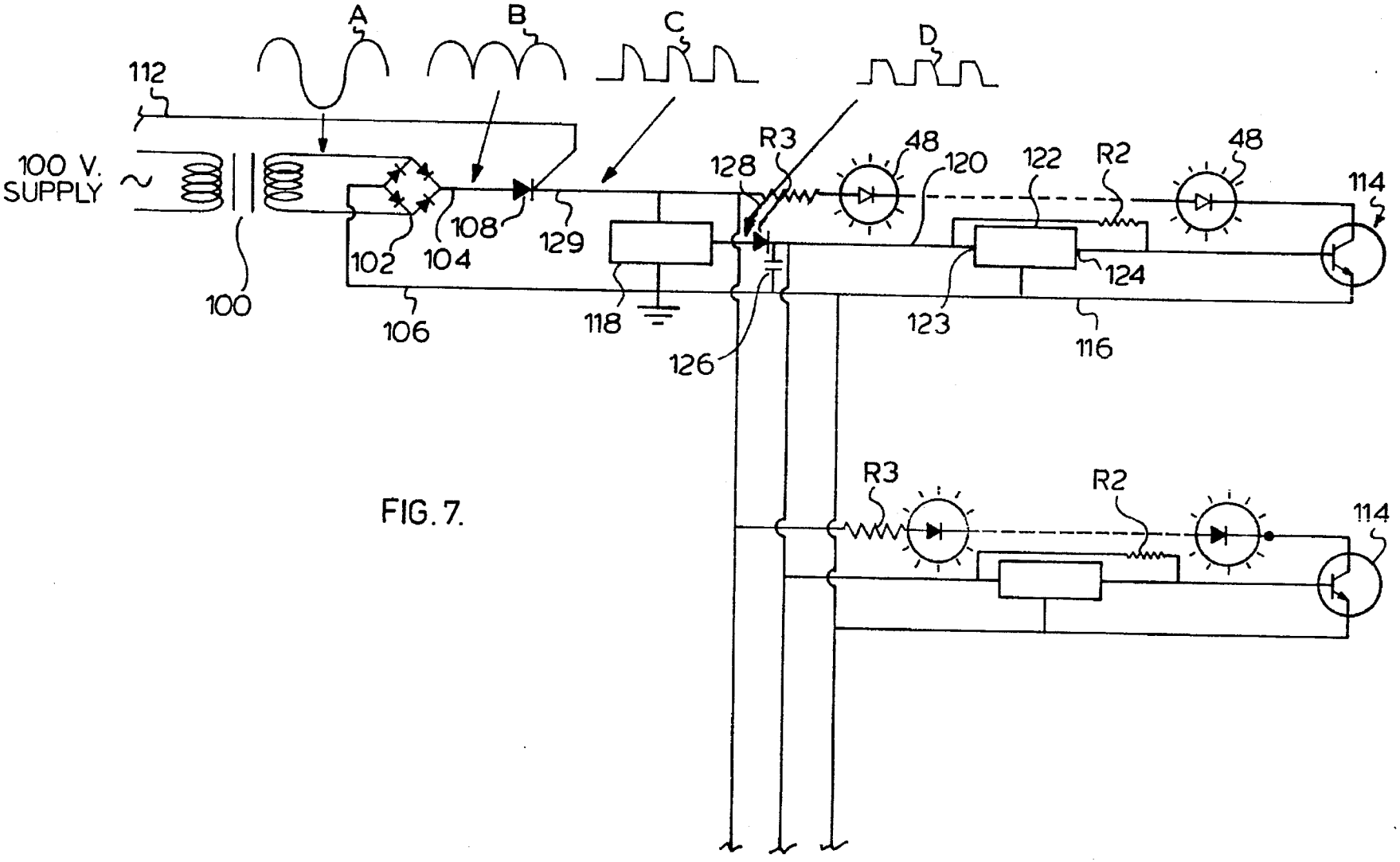
Figures 8, 9:
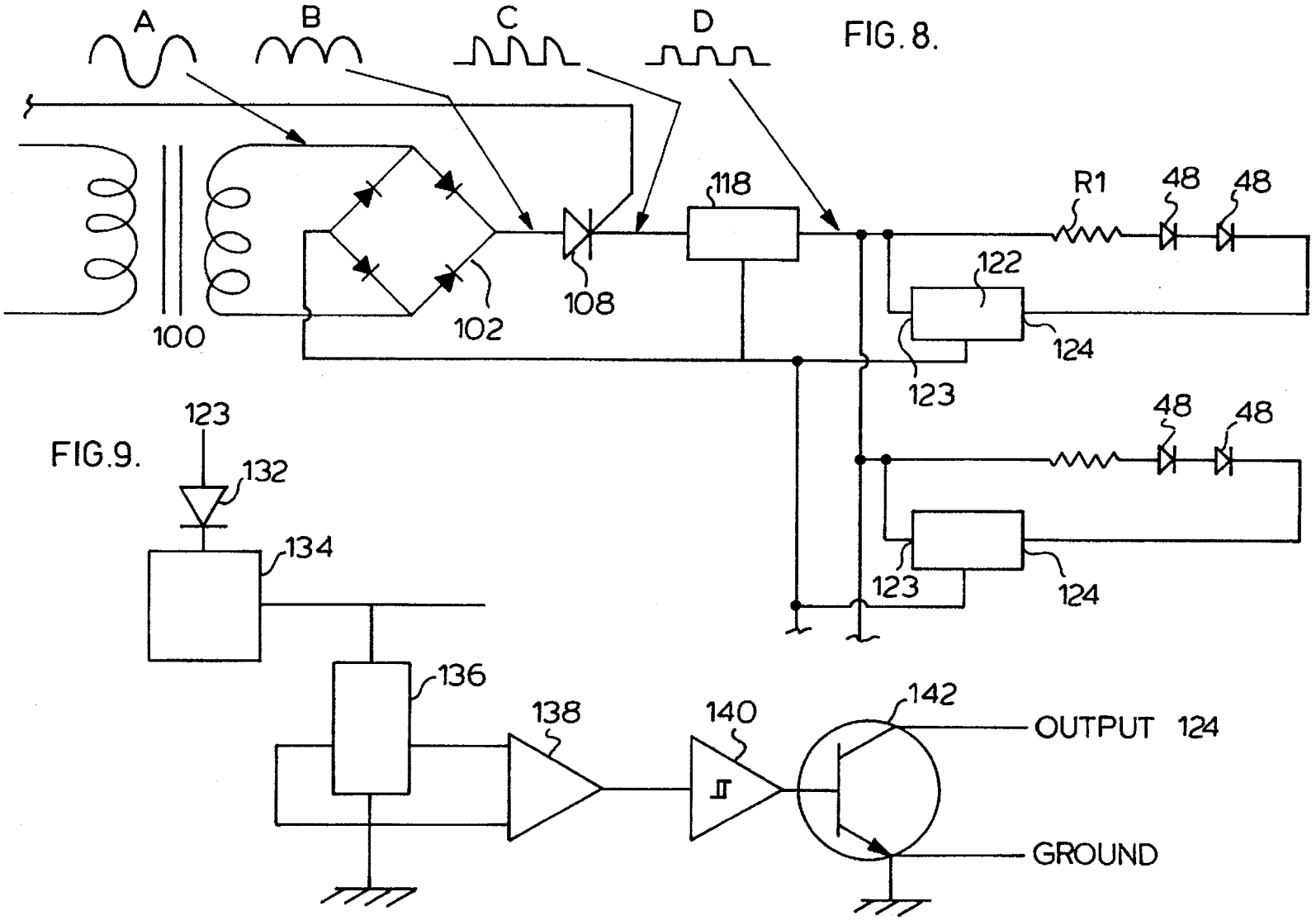

In the drawings which illustrate a preferred embodiment for the invention:

FIG. 1 is a perspective view of a portion of a display in accord with the invention, FIG. 2 is a perspective view of a display element bracket, FIG. 3 is a view, looking upward and to the left in FIG. 1 transverse to a display row, and to the viewing direction, of an element in OFF orientation and showing the position of the Hall switch, FIG. 4 is a view, in the same direction as FIG. 3, showing display elements in ON position, FIG. 5 is a view, in the viewing direction, showing a portion of a display with an element in ON and an element in OFF orientation, FIG. 6 is a view taken along a rotor axis showing the operation of a display element, (looking leftward in FIG. 1, and 3), showing the disk in OFF position, FIG. 6A is a partial view showing the elements of FIG. 6 in ON position, FIG. 7 shows a preferred circuit containing the Hall effect switch, FIG. 8 shows an alternative circuit containing the Hall effect switch, and FIG. 9 is demonstrative of the circuitry of a Hall effect switch.

In the drawings, a row of regularly spaced brackets 10, mounted on a base 17, support a mounting shaft 16 for a plurality of disks each corresponding to a space between brackets 10. Defining each such space are a pair of brackets 10 having an upwardly open slot 12. Slot 12 is shaped to define a lower slot length 11,an intermediate narrow portion with facing concavities 14 to receive the mounting shaft 16 and an upper wide portion tapered at 18 to permit shaft entry into the concavities. Thus the single shaft 16 for a row of brackets 10 and shaft (after the mounting of individuals disks, to be described) may be pressed into place with a snap action, taking advantage of the limited inherent resiliency of the plastic of which such brackets are molded, which resiliency is enhanced by the lower slot length 11.

The disks 18A, 18B are usually circular in shape and define ears 20 at diametrically opposed locations which are apertured to rotatably slide on the shaft 16. On one of the ears, (to the left in FIG. 1) a round axially thin magnet 22 is centrally apertured for such slidable rotation, and is attached to the ear for rotation with the disk.

The magnet 22 is magnetized to define a polar axis along its diameter which for reasons to be described, is oriented to be at about 45° to the face of the disk.

The disk is provided with a stop 24 to limit (counterclockwise looking right in FIG. 1) rotation of the disk when the plane of the disk is perpendicular to the bracket.

The disk in this orientation defines a viewing direction V which is the centre of a cone of preferred viewing directions perpendicular to the disk plane. The disks as a whole in this orientation will collectively define the 'plane of the array'. The disks will not always be strictly parallel to the plane of the array. For example if the array is mounted to indicate road conditions to the drivers on a freeway, the plane of the array will often be vertical. However the disks will be oriented in their ON position define a viewing direction V tilted relative to the horizontal to be clearly visible to the drivers from an overhead support.

The disks 18A, 18B herein are fully disclosed in commonly owned U.S. Pat. 5,050,325 dated Sep. 24, 1991 and the contents of this patent are incorporated herein by reference. However the invention may be realized and its objects accomplished by any magnet bearing disk which may be driven by a magnetic field forming core. As elsewhere explained the invention may also be accomplished by non-rotatable but movable elements which are driven by a field forming core.

Each disk 18A, 18B preferably comprises a rim 19 from which ears 20 integrally extend. An integral spline 21 extends diametrically across the rim between the ears with a longitudinally extending groove to receive shaft 16. A slightly resilient web 23 extends to the rim about the web's circumference, passes over spline 21 on the side remote from shaft 16 to be removably held in place (slightly flexed over the spline) by tabs 25 extending inwardly from the inner periphery of rim 19. The web is apertured at 26 to allow light passage from the LED cluster to be described, in the ON position of the disk. The web is brightly coloured on the side 28 which faces the viewing direction in the ON position of the disk and darkly coloured on the opposite side 30. The disk is also provided with a stop (cylinder 27 to be described) limiting rotation at just over 90° clockwise looking right on FIG. 1 to the first position.

The disks 18A, 18B are brightly coloured (and may in some applications be fluorescent in daylight or retroreflecting) on the side 28 facing and visible to a viewer looking in the viewing direction when approximately parallel to the plane of the array. (See 18A FIG. 5). This is referred to herein as the 'ON' position. The disk is of dark and non-reflecting color on the opposite side 30. When the disk rotates to its other limiting position (set by cylinder 27) known as the 'OFF' position (See 18B FIG. 5) where the ON side of the disk is obscured in the viewing direction.

The brackets 10 and base 17 are darkly colored to match the opposite side 30 of the disk. Thus when opposite side 30 is displayed in the viewing direction, as with disk 18B in FIG. 5, the disk 30 blends with the brackets and base and is substantially invisible to the viewer. On the other hand the bright side of disk 18A contrasts with the base and bracket.

The bracket 10 which is to the left of each disk in FIG. 1 holds a vertically oriented core 44. On the side of such bracket 10, which faces the disk, a flat generally horizontal projection 36 is provided with recess 37 to receive the upper end of the core 44. A flat, generally horizontal projection 38 has an upwardly facing recess 40 which is dimensioned to receive the lower end of the core 44. The projection 38 is dimensioned to have a limited resiliency and may be lowered to allow the insertion of the upper core end in the upper recess then released to receive in recess 40, the lower core end.

The core is provided with an energizing winding 42 which may be pulsed in either voltage polarity to respectively magnetize the core in either magnetic polarity. In accord with the purposes of the invention the core is selected to have high refinance or to be a hard 'magnet' so that it maintains its magnetic polarity between pulses.

The energizing winding terminates a short distance from each core end. The non-wound upper end of the core is contained in the recess 37. The unwound lower end of the core 44 is best shown in FIG. 3. Leads 46 and 48 from the coil ends lead to the power source, not shown, to supply the polarizing pulses to the coil. In accord with the ordinary operation of an array, each core will be independently magnetized, and hence each disk will independently assume its ON or OFF position.

The upper core end is located in sufficiently close proximity to magnet 22 so that the field created by the core controls the orientation of the magnet to place the disk in ON or OFF orientation. However the magnet 22 must not be located too close to the magnet. If too close the magnet will nullify or overcome the magnetization at the adjacent end of the core and cause the disk to 'latch' in its then position. The bracket 10, and its core holding members 36 and 38 are made of non-magnetic material (here molded plastic) so that the presence of these members does not materially affect the magnetic field.

The magnet 22 as best shown in the OFF position of FIG. 6 is magnetized to provide a polar axis between north and south poles, $N_D$ and $S_D$ respectively, with the magnetic polar axis being oriented at about 45° to the plane of the disk.

In accord with the operation of the disk, if the upper core end has been previously pulsed to provide a north pole this attracts the pole $S_D$ on magnet 22 and holds the disk in the solid line OFF position of FIG. 6 (obscuring the disk's bright side in the viewing direction). When the core is pulsed to create a south pole at the upper coil end, the magnet then causes the disk to rotate to the ON position (FIG. 6A) (displaying the disk's bright side in the viewing direction). Further reversal of the core polarity will rotate the disk back to the OFF position.

In the preferred embodiment just described the disks in a row rotate loosely on the same mounting shaft. However, the operation, so far as the invention is concerned, is the same if each disk rotates separately on its own mounting shaft or spindle, as demonstrated in U.S. Pat. 5,055,832.

Each disk is provided with an eccentrically located aperture here circular aperture 26. Aligned with the aperture in the viewing direction is a cluster of LEDs 48 to pass the light of the LEDs in the viewing direction in ON position. The cluster is typically contained in a cylinder 27 whose axis extends in the viewing direction V and whose walls preferably extend outwardly beyond the LED cluster. The extension of the cylinder wall beyond the LEDs reduces the incidence of sunlight on the LEDs. Such LEDs typically have focussing lenses and such lenses may focus the sunlight on the LEDs and damage them.

The cylinder and BED cluster are mounted on the base and located to shine through disk aperture 46 when the disk is in the ON orientation.

Each standard 10 is provided with a square aperture 146 facing the unwound lower end 44 of the core. Locate in this aperture (Compare FIGS. 2 and 3) is a Hall switch 122 with a sensor 136 hereinafter described.

It is desired at this point to describe the LED power and control circuitry. An array will typically comprise display elements usually in 7×5 blocks of 7 rows and 5 columns. In such a block a letter or number or other design may customarily be formed by the selective display of ON and OFF disks and as many blocks may be provided as desired. However the invention is equally applicable to a multi element display which is otherwise arranged.

In the drawings there is provided a step-down transformer 100 from the 110 volt supply to a suitable voltage, here 36 volt rms. The transformer output (waveform A) is supplied across rectifier bridge 102 to supply the cyclic positive signal (Waveform B) on line 104 relative to ground connector 106. Line 104 is connected to the input of a phase control means or dimmer switch 108. Those control means 108 is preferably a silicon controlled rectifier (SCR) operated from a phase control which is a well known device for phase shifting the switching point of each positive cycle in waveform B. The output of the SCR goes to zero when signal B at its input goes to zero. The 60 cycle control, phase shifter and gated diode are well known to those skilled in art. A Triac may be used instead of the SCR. The output of the SCR is in the form of waveform C on line 129 which is identical to waveform B except that the start is delayed by a controllable phase angle in accord with the setting of the dimmer. The output of the SCR is connected to the series connected LEDs associated with each disk in the array through a resistance R3 to the collector of NPN transistor switch 114 whose operation will be dealt with hereafter. The dimmer is adjusted, as desired, by means, not shown, to control the brightness of the LEDs through the phase angle of each cycle passed.

The emitter of each transistor switch 114 is connected to ground through connection 116 (an extension of line 106). Thus it will be seen that, for each element in array, the LED cluster will be illuminated when transistor switch 114 is closed, and the brightness will be determined by setting of the dimmer switch 108.

As will be noted from the description to follow, the state of each transistor switch 114 is individually controlled by the circuitry to be described.

Between lines 104 and 106 is connected a three terminal regulator which acts as a clipper or voltage clamp 118. The purpose is to receive at the input the voltage between lines 104 and 106 and provide, between line 120 and 116 a voltage which is acceptable (in this embodiment 24V) to the Hall effect switch. The output of the clipper is thus connected to the supply input 123 of the Hall switch along line 120 to provide the control current for the Hall switch 122. The Hall switch contains a Hall device, arranged as shown in FIG. 9 to connect the output terminal 124 to ground, when the Hall element, correctly located and oriented, detects a field of one polarity and to disconnect the output terminal 124 from ground when the field is in the other polarity.

Each line 120 is connected to ground through capacitor 126 to prevent the supply voltage at each terminal 123 falling low enough (between peaks) to turn off the Hall device. If the Hall device turned off between peaks the SCRs might glow (when it is desired that they be off) sufficiently to be a distraction at night.

Rectifier 128 connected on line 120 between the capacitor 126 and the clipper 118 output, prevents the positive voltage at capacitor 126 appearing at the clipper output.

Line 120 is connected through resistor R2 to the line joining the Hall switch output terminal 124 and the base of transistor 114, to supply base current to 114 when the Hall switch is off.

FIG. 9 shows a functional schematic of a typical Hall switch 122. As indicated the positive voltage at terminal 123 passed through rectifier 132 is regulated at regulator 134 and applied as the Hall current to ground across the Hall element 136 which is responsive to magnetic flux components in the direction perpendicular to the sheet in FIG. 9 and also in FIG. 6. (The rectifier 132 prevents signal of the undesired polarity being applied to regulator 134.) The resultant output voltage is applied to amplifier 138 and to Schmitt trigger 140 whose output is, in turn connected to the base of transistor 142. The collector of transistor 142 is output 124 and the emitter of transistor 124 is connected to ground the output terminal on line 116 of FIG. 7.

The Hall voltage polarity is determined by the polarity of the magnetic field across sensor 136 so that in one polarity transistor 142 conducts and closes the connection from R2 to ground and in the other polarity the transistor is turned off and R2 is floating. The Schmitt trigger provides a digital output which turns 'on' the transistor at a voltage input level and turns 'off' the transistor at a lower voltage level (so that oscillation of the output is avoided).

The Hall switch 122 is located where its element 136 will sense the polarity of the magnetic flux from the unwound lower end of core 44. For this purpose the bracket 12 is provided with a square recess 146 in its base which receives the Hall element, with its sensor 136 facing the core end 44. The Hall switch is mounted in position on three leads (to terminals 123, 124 and the ground terminal) which extend through the base of the bracket and base 17 for connection to the circuitry shown in FIG. 7.

The Hall sensor 136 must be oriented so that with a disk in the ON position, (see 18A, FIG. 5) the field from core 44 is such that the transistor 142 is off and the transistor 114 is on so that the associated LED's 48 are on and augment, to the viewer the appearance in direction V of bright disk side 28. On the other hand, with a disk in the OFF position,(see 18B, FIG. 5) the field affecting sensor 136 is reversed so the transistor 142 is on, and the transistor 114 off. A viewer looking toward the disk in the viewing direction, will therefore not see the disk 18B whose bright side is obscured so that the dark side 30 will blend with the similarly dark colored brackets and base and the associated LEDs will be off.

When it is, for example, desired to switch disk 18A to OFF, the associated winding 42 is pulsed to reverse the core polarity, and rotate the disk to the solid line position of FIG. 5. The reversal of the core polarity causes the Hall sensor 136 to switch the transistor 142 on, the transistor 114 off and the associated LEDs will be extinguished.

Where the voltage peak output of transformer 100 is only slightly above that which the Hall switch 122 will tolerate, the circuitry of FIG. 8 may be substituted for that of FIG. 7. The transformer 100, rectifier bridge 102 and phase control 108 act as in FIG. 7 and produce similar waveforms A, B, C although smaller in amplitude. The output of the phase control, 108 is fed through clipper 118 which clips the peaks of the waveform C to a level acceptable to each Hall switch 122. (If the peaks are already below the acceptable limits of the Hall switch the clipper is not required.) The output of the clipper 118 (or of the phase control if the clipper is absent) is fed to the series connected LEDs 48 through a resistance R1, and to the control terminal 123 of the Hall switch 122. The other side of the LEDs is connected to the output terminal 124 of the Hall switch 122.

In operation, in one polarity of the associated core end 44 is such as to turn on transistor 142 the LEDs will be lit and when the polarity is such as to turn off transistor 142 the LEDs will be off.

Since the state of the transistor 142 has the opposite relationship to the state of the LEDs in FIGS. 7 and 8, care must be taken that the orientation of the Hall element is chosen in each case so that the LEDs are on, when the bright side of the associated disk is displayed in the viewing direction, and off when the dark side is so displayed.

Considering the circuitry of either FIGS. 8 or FIG. 9 it will be seen that the output of the dimmer 118 is supplied to one side of all the LED clusters in an array. However the other side of each LED cluster is individually connected or not to ground, by the Hall switch in accord with the core polarity of the corresponding disk. Hence each LED cluster is individually controlled to be on and off when, respectively, the disk bright side is displayed or obscured in the viewing direction.

It will be appreciated that, instead of an LED circuit, the Hall switch, as located and described may be used to control different types of circuits. Such circuits are not limited but would include the operation of a slave display or a circuit for reporting to a monitor the state of the associated display disk.

It will be appreciated that although the disk contains an aperture for passage of the rays from the light, in ON position, a notch or other removed portion may be used for the same purpose.

I claim:

1. In a display device defining a viewing direction, comprising a movable element designed to move relative to a stator between a first position where a bright side is displayed in the viewing direction and a second position where said bright side is obscured in the viewing direction, said movable element mounting a magnet for movement therewith, said stator being designed to movably support said movable element for movement between said first and second positions, an electromagnetic high remanence core mounted on said stator switchable by an associated winding, adapted in one polarity to provide a field to influence said magnet to bias said element to said first position and in the opposite polarity to provide a field to influence said magnet to bias said element to said second position, a circuit including a switch adapted to have an open, and a closed, state, a Hall effect device having a sensor located in said field and adapted, in said one and other polarity to close and open said switch, respectively.

2. In a display device as claimed in claim 1 wherein said movable element is a rotor, rotatably mounted on a stator, defining a bright side for display in said viewing direction in ON orientation and rotatable to OFF position where said bright side is obscured in said OFF position.

3. A device as claimed in claim 1 in combination with a light located, when on, to augment the appearance of the said bright side in the viewing direction, said light being connected to be on in the state of said switch corresponding to the polarity biasing said movable element to said position displaying its bright side in the viewing direction.

4. In a display device defining a viewing direction comprising a magnetic field forming member adapted to provide fields of one and the other polarity, a movable element responsive to said one and the other polarity to assume respectively, a first and a second position, a Hall switch having a sensor located in said magnetic field and adapted to produce a voltage of polarity determined by the polarity of said field.

5. In a display device as claimed in claim 4 wherein said movable element is a rotor, rotatably mounted on a stator, defining a bright side for display in said viewing direction in ON orientation and rotatable to OFF position where said bright side is obscured in said OFF position.

6. A device as claimed in claim 4 in combination with a light located, when on, to augment the appearance of the said bright side in the viewing direction, said light being connected to be on in the state of said switch corresponding to the polarity biasing said movable element to said position displaying its bright side in the viewing direction.

7. A display device having an element electromagnetically controlled by the field of a magnetic field forming core which field is reversible, said element being biassed in one and the other polarity of said core, to respectively display or obscure a bright surface to viewers in a viewing direction, a Hall switch located in said field to be in closed state in one polarity of said field and to be in open state in the other polarity of said field.

8. A display device as claimed in claim 7 including a light connected in a circuit controlled by said Hall switch to be ON and OFF, respectively, in one and the other state of said Hall switch, said light when ON being visible in said viewing direction, said Hall switch being arranged so that said light is ON and OFF respectively when said core polarity provides respective fields to bias said element to displaying or obscure respectively, said bright surface in the viewing direction.

9. A device as claimed in claim 7 in combination with:

means for deriving from an alternating current a cyclical signal of one polarity, phase control means for receiving said derived signal and providing therefrom a controllable portion of successive cycles of said derived signal, wherein the output of said phase control means is connected to energize said light when said switch is closed.

10. An array of display devices as claimed in claim 9 wherein the output of said phase control means is connected to energize said light in a plurality of said devices and each said Hall switch is controlled by the polarity of individual devices in said polarity.

11. A device as claimed in claim 8 in combination with:

means for deriving from an alternating current supply a cyclical signal of one polarity, phase control means for receiving said derived signal and providing therefrom a controllable position of successive cycles of said derived signal, wherein the output of said phase control means is connected to energize said light when said switch is closed.

12. An array of display devices as claimed in claim 8 wherein the output of said phase control means in connected to energize said light in a plurality of said devices and each said Hall switch is controlled by the polarity of individual devices in said polarity.

* * * * *